US009234475B2

(12) United States Patent
Gwidt et al.

(10) Patent No.: US 9,234,475 B2
(45) Date of Patent: Jan. 12, 2016

(54) METHOD OF STARTING SPARK-IGNITION DIRECT INJECTION (SIDI) ENGINES

(75) Inventors: Jesse M. Gwidt, Brighton, MI (US); Michael N. Kotsonas, Highland, MI (US); Robert X. Monchamp, Ann Arbor, MI (US); Karen Margaret-Bell Gwidt, Brighton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1408 days.

(21) Appl. No.: 12/335,989

(22) Filed: Dec. 16, 2008

(65) Prior Publication Data

US 2010/0147240 A1 Jun. 17, 2010

(51) Int. Cl.

| | |
|---|---|
| ***F02D 17/02*** | (2006.01) |
| ***F02D 13/06*** | (2006.01) |
| ***F02D 41/06*** | (2006.01) |
| ***F02D 41/00*** | (2006.01) |
| *F02D 41/30* | (2006.01) |

(52) U.S. Cl.

CPC ..... *F02D 41/064* (2013.01); *F02D 41/0087* (2013.01); *F02D 13/06* (2013.01); *F02D 17/02* (2013.01); *F02D 41/30* (2013.01)

(58) Field of Classification Search

CPC ..... F02D 17/02; F02D 41/0087; F02D 13/06; F02D 17/00; F02D 17/04; F02D 33/00; F02D 33/006

USPC ..... 123/179.16, 179.17, 464, 512, 513, 123/179.3, 179.7, 179.14, 179.18, 198 C, 123/198 D, 198 DB, 198 DC, 198 F, 123/FOR. 113, FOR. 119, FOR. 120, 446, 123/447, 453, 456, 457, 480, 481, 490, 491, 123/494; 701/112, 113

See application file for complete search history.

(56) References Cited

U.S. PATENT DOCUMENTS

| | | | | |
|---|---|---|---|---|
| 6,257,207 | B1 * | 7/2001 | Inui et al. | 123/491 |
| 6,571,772 | B1 * | 6/2003 | Ott et al. | 123/481 |
| 6,763,807 | B1 * | 7/2004 | Gilles et al. | 123/435 |
| 6,918,367 | B2 * | 7/2005 | Denz et al. | 123/179.17 |
| 7,210,464 | B2 * | 5/2007 | Ukai et al | 123/497 |
| 7,478,625 | B1 * | 1/2009 | Gwidt et al. | 123/481 |
| 7,516,730 | B2 * | 4/2009 | Ukai et al. | 123/198 F |

FOREIGN PATENT DOCUMENTS

| | | | |
|---|---|---|---|
| CN | 1936307 | A | 3/2007 |
| CN | 101113694 | A | 1/2008 |
| DE | 4446277 | A1 | 6/1996 |
| DE | 102007016764 | A1 | 10/2008 |
| JP | 2008128018 | A | 6/2008 |

* cited by examiner

*Primary Examiner* — Hai Huynh
*Assistant Examiner* — Raza Najmuddin

(57) ABSTRACT

A cold start control module for a direct injection engine includes a fuel flow determination module and a cylinder activation/deactivation module. The fuel flow determination module determines a requested fuel flow. The cylinder activation/deactivation module deactivates at least one of cylinders when the requested fuel flow exceeds a maximum fuel flow of the fuel pump during cold start.

16 Claims, 3 Drawing Sheets

METHOD OF STARTING SPARK-IGNITION DIRECT INJECTION (SIDI) ENGINES

FIELD

The present disclosure relates to spark-ignition direct injection (SIDI) engines, and more particularly to methods of starting SIDI engines.

BACKGROUND

The background description provided herein is for the purpose of generally presenting the context of the disclosure. Work of the presently named inventors, to the extent that it is described in this background section, as well as aspects of the description that may not otherwise qualify as prior art at the time of filing, are neither expressly nor impliedly admitted as prior art against the present disclosure.

Spark ignition direct injection (SIDI) engines have improved fuel economy and increased power over conventional port fuel-injected combustion engines. A fuel injection system for an SIDI engine is operated at high pressure to spray fuel directly into combustion chambers. A fuel pump for supplying the fuel to a fuel rail at high pressure may be mechanically driven by the engine. During engine cold start, the engine may not have sufficient power to drive the fuel pump to generate the desired high pressure. Further, the engine generally requires a richer air/fuel mixture at cold start to maintain constant speeds and thus requires even higher fuel pressure. The fuel pump of the SIDI engine may not be able to meet the fuel demand at engine cold start. A fuel pump with a larger capacity may improve performance of the SIDI engine at cold start while increasing manufacturing costs of the engine.

SUMMARY

Accordingly, a cold start control module for a direct injection engine according to teachings of the present disclosure includes a fuel flow determination module and a cylinder activation/deactivation module. The fuel flow determination module determines a requested fuel flow. The cylinder activation/deactivation module deactivates at least one of cylinders when the requested fuel flow exceeds a maximum fuel flow of the fuel pump during cold start.

In other features, the activation/deactivation determination module determines a number of the cylinders that are needed to be deactivated based on the requested fuel flow and the maximum fuel flow of the fuel pump. The maximum fuel flow is directly proportional to engine speed. The cylinder activation/deactivation module deactivates the number of cylinders when engine speed is below a threshold. The fuel flow determination module determines an equivalence fuel ratio (EQR) based on a fuel flow request.

A method of starting a direct injection engine according to teachings of the present disclosure includes determining a requested fuel flow and deactivating at least one of the cylinders when the requested fuel flow exceeds a maximum fuel flow of the fuel pump during cold start.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
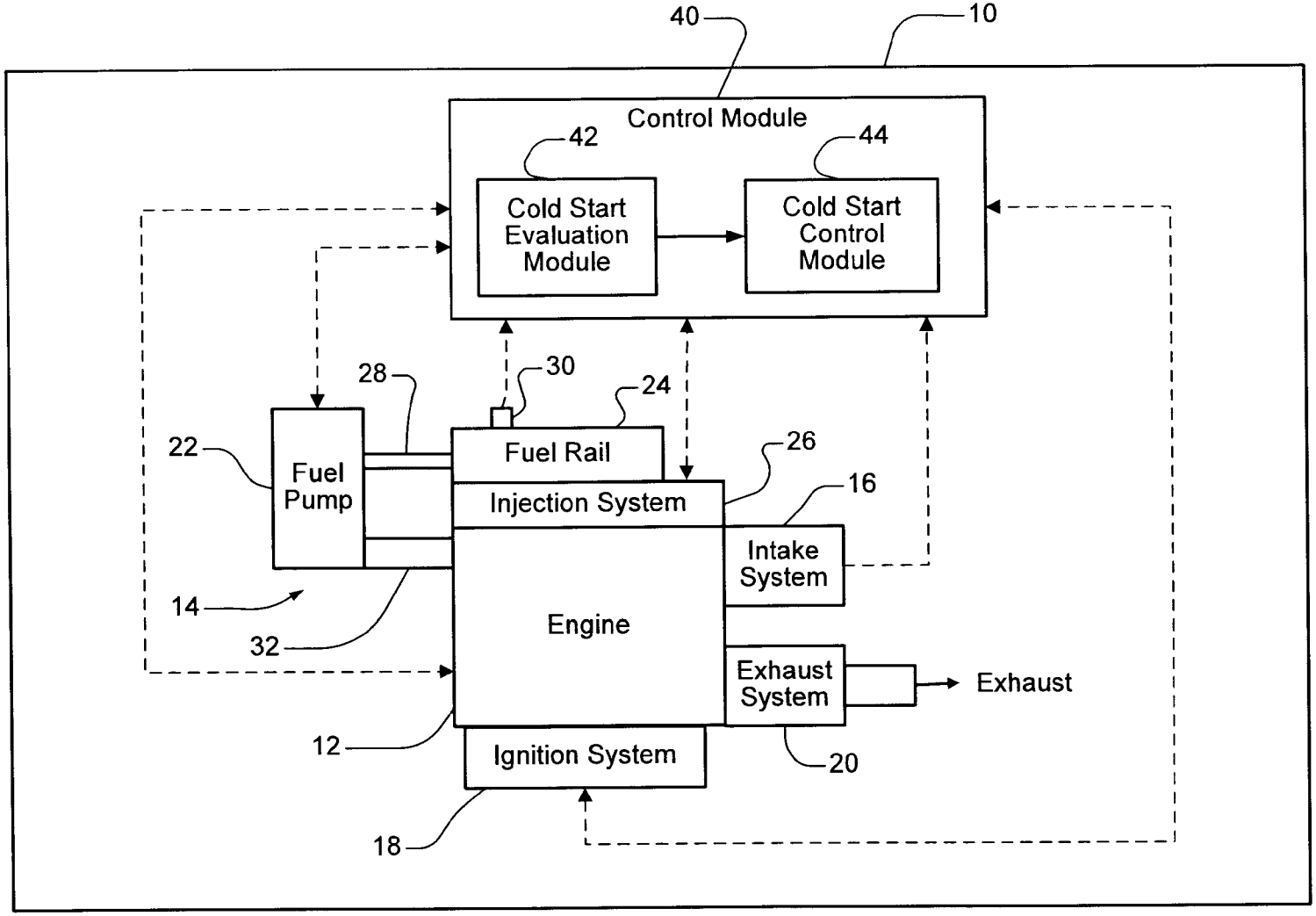
FIG. 1 is a functional block diagram of an engine system that includes a cold start control module according to the present disclosure.

The following description is merely exemplary in nature and is not intended to limit the present disclosure, application, or uses. It should be understood that throughout the drawings, corresponding reference numerals indicate like or corresponding parts and features. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

During a cold start, an SIDI engine system according to the present disclosure determines a requested fuel flow and deactivates at least one engine cylinder based on the requested fuel flow and maximum fuel flow of a fuel pump that supplies high pressure fuel to a fuel rail. With reduced number of activated cylinders, the fuel pump supplies more fuel to the activated cylinders to meet the high fuel demand at cold start.

Referring to FIG. 1, an engine system 10 in accordance with the teachings of the present disclosure includes an engine 12, a fuel system 14, an intake system 16, an ignition system 18, and an exhaust system 20. The fuel system 14 provides fuel to the engine 12. The engine 12 is a direct injection system where fuel is injected directly into a combustion chamber of a cylinder at high pressure. The intake system 16 provides air to the engine 12. The ignition system 18 provides a spark to ignite the fuel and air mixture in the combustion chamber of the engine 12. Combustion of the air-fuel mixture in the engine 12 provides power that is transferred to a transmission (not shown) and concurrently produces exhaust. The exhaust exits the engine 12 through the exhaust system 20.

The fuel system 14 includes a fuel pump 22, a fuel rail 24, an injection system 26, a fuel line 28, and a pressure sensor 30. An engine crankshaft (not shown) drives the fuel pump 22 through a camshaft mechanism 32. The fuel pump 22 is a high pressure fuel pump that provides high pressure fuel to the fuel rail 18 through the fuel line 28. The fuel pump 22 controls a fuel mass quantity that flows to the fuel rail 24 by adjusting the fuel mass quantity that is trapped within a piston cylinder of the fuel pump 22. The fuel pump 22 may provide a fuel rail pressure, for example only, in the range of 6 MPa to over 20 MPa.

The fuel rail 24 delivers the high pressure fuel to the injection system 26. The injection system 26 includes a plurality of fuel injectors (not shown) that communicate with the fuel rail 24 and that provide fuel sequentially and directly to the combustion chambers of the cylinders. The pressure sensor 30 is provided at the fuel rail 24 to monitor the rail pressure.

A control module 40 includes a cold start evaluation module 42 and a cold start control module 44. The cold start evaluation module 42 receives data from a plurality of sensors (not shown) and evaluates whether a cold start condition is present. A cold start condition may be present, for example only, when catalysts in the exhaust system 20 are below a threshold temperature. When a cold start condition is present, the cold start control module 42 is activated.

Figure 2:
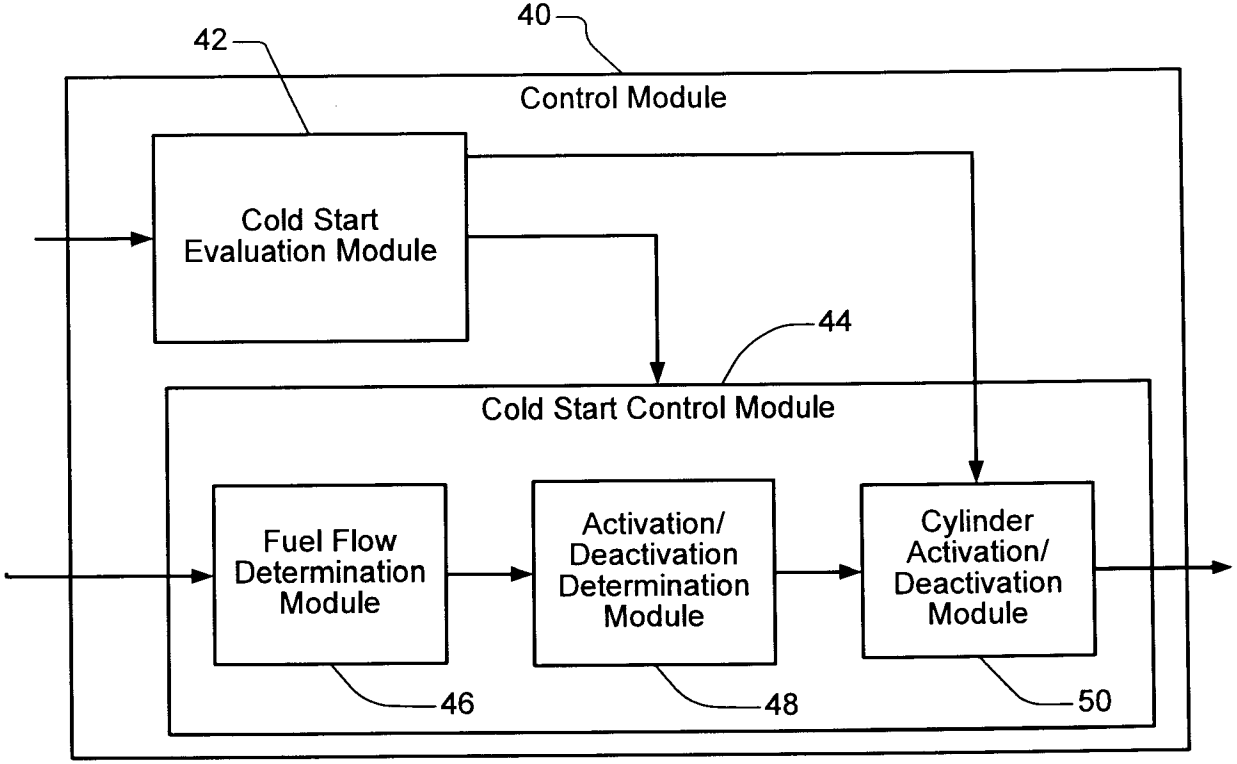
FIG. 2 is a functional block diagram of a control module that includes a cold start control module according to the present disclosure.

Referring to FIG. 2, the cold start control module 44 includes a fuel flow determination module 46, an activation/deactivation determination module 48 and a cylinder activation/deactivation module 50. The fuel flow determination module 46 determines a requested fuel flow for each cylinder based on engine parameters. More specifically, the fuel flow determination module 46 determines a requested equivalence ratio (EQR) based on a fuel flow request from the control module 40.

Equivalence ratio (EQR) refers to a ratio of a commanded fuel/air ratio to a stoichiometric fuel/air ratio. The stoichiometric fuel/air ratio refers to a fuel/air ratio where the fuel is completely oxidized. When the requested EQR is greater than 1, a fuel-air mixture that is richer than the stoichiometric ratio is required. When the requested EQR is less than 1, a fuel-air mixture that is leaner than the stoichiometric ratio is required. The EQR gives an indication of percentage of excess fuel greater than the fuel in stochiometric fueling. For example, an EQR of 1.146 means the engine needs 14.6% more fuel than needed for stoichometric combustion. For a direct injection engine in a maximum power condition and with catalyst protection enabled, the EQR may be in the range of 1.3 to 1.8.

The activation/deactivation determination module 48 compares the requested EQR with the capacity (i.e., maximum fuel flow) of the fuel pump and determines whether the requested EQR exceeds the maximum fuel flow of the fuel pump 22 at a particular engine speed. The maximum fuel flow of the fuel pump is directly proportional to engine speed. During cold start, a rich fuel/air mixture may be requested to aid in engine starting. The maximum fuel flow of the fuel pump may be too low at low engine speeds to provide the requested fuel flow. If the requested EQR exceeds the maximum fuel flow of the fuel pump 22 at a particular engine speed, deactivation of cylinders is needed. The activation/deactivation determination module 48 determines the number of cylinders to be deactivated based on the requested EQR and the maximum fuel flow of the fuel pump 22. The cylinder activation/deactivation module 52 closes some of the injectors and deactivates the associated cylinders. Because the fuel pump 22 supplies fuel to only some of the cylinders, the fuel pump 22 can supply more fuel to each active cylinder to meet the high fuel demand.

The requested EQR may change during cold start. The maximum fuel flow of the fuel pump also varies with engine speeds. Therefore, the fuel flow determination module 46 may determine a requested EQR and the activation/deactivation determination module 48 may compare the requested EQR with the maximum fuel flow of the fuel pump at regular intervals. Monitoring the requested EQR and the maximum fuel flow at regular intervals ensures that the number of currently active cylinders correspond to the maximum fuel flow of the fuel pump. If the requested EQR does not exceed the maximum fuel flow of the fuel pump, the activation/deactivation determination module 48 determines whether some of the already-deactivated cylinders should be activated to aid in engine starting and determines the number of cylinders that should be activated. The cylinder activation/deactivation module 50 then activates some of the deactivated cylinders to achieve the requested EQR without exceeding the maximum fuel flow of the fuel pump. The cylinder activation/deactivation module 50 continues to activate the deactivated cylinders depending on the constantly-monitored EQR and maximum fuel flow of the fuel pump until all cylinders are activated for normal operations. When the engine operates normally, the engine has attained sufficient engine speed (i.e., above a threshold speed) to provide sufficient power to the fuel pump. As a result, the fuel pump 22 can generate the required high pressure to meet the fuel demand during engine normal operations.

The cold start control module 44 according to the present disclosure has the advantage of increasing fuel selections. Conventional direct injection engines are designed exclusively for gasoline. The hardware and software associated with the conventional engines may function well only for a narrow range of air/fuel ratios. To use different types of fuels, an engine may need to be operated in a wide range of air/fuel ratios.

For example, when ethanol 85 is used, the engine may require a richer air/fuel mixture (for example only, 27%-30% more fuel) than when gasoline is used under similar conditions. The high pressure fuel pump 22 of the conventional engine may not have the capacity to provide rich fuel during normal operations and cold start. With the cold start control module 44 of the present disclosure, however, some of the cylinders may be deactivated to allow the remaining active cylinders to receive more fuel to meet the higher fuel demands. As such, the engine 12 can be operated in a wide range of fuel/air ratio and thus can be operated using a variety of fuels without changing the hardware design or increasing the capacity of the fuel pump.

Figure 3:
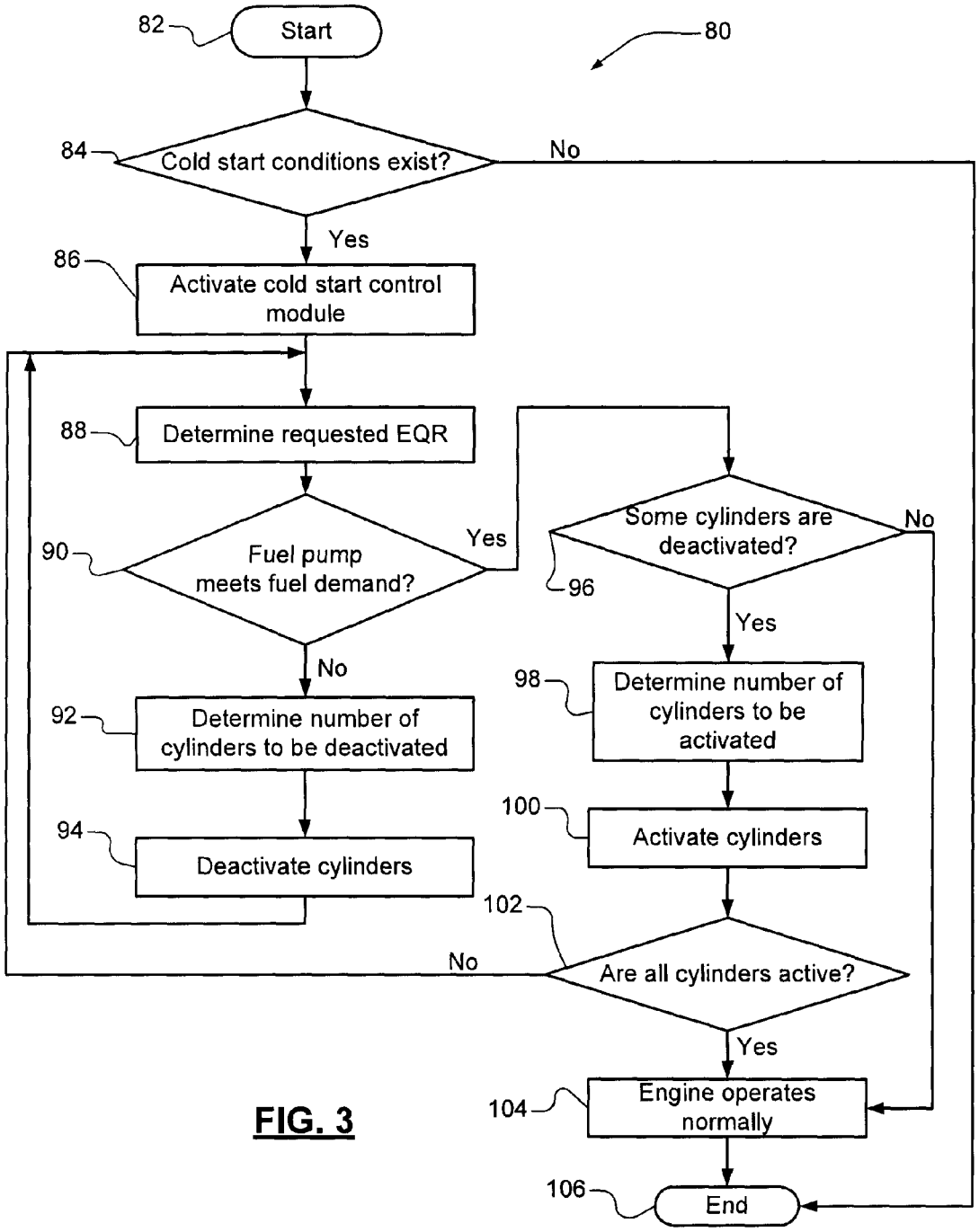
FIG. 3 is a flow diagram of a method of starting an SIDI engine according to the present disclosure.

Referring to FIG. 3, a method 80 of starting an SIDI engine starts in step 82. The engine condition evaluation module 44 determines whether the engine is under cold start conditions in step 84. If the engine is under cold start conditions, the cold start control module 44 is activated in step 86. The fuel flow determination module 46 determines a requested fuel flow (or a requested EQR) based on a fuel flow request in step 88. The activation/deactivation determination module 48 determines whether the fuel pump 22 can meet the fuel demand based on the requested EQR in step 90. If the fuel pump 22 cannot meet the fuel demand, the activation/deactivation determination module 48 determines number of cylinders that need to be deactivated in step 92. The cylinder activation/deactivation module 50 deactivates some of the cylinders in step 94.

The method 80 returns to step 88 to continue to determine a requested EQR based on engine parameters. If the fuel pump meets the fuel demand in step 90, the activation/deactivation determination module 48 determines whether some of the cylinders are in a deactivated state in step 96. The activation/deactivation determination module 48 also determines whether some of the deactivated cylinders need to be activated in step 98. The cylinder activation/deactivation module 50 activates some of the deactivated cylinders to match the maximum fuel flow of the fuel pump in step 100. If not all cylinders are active in step 102, the method 80 returns to step 88 to continue to determine a requested EQR and controls the activation/deactivation of cylinders until all cylinders are active. When all cylinders are active in step 102, the engine operates normally in step 104. The method 80 ends in step 106.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, specification, and the following claims.

What is claimed is:

1. A cold start control module for a direct injection engine comprising:

a fuel flow determination module that determines a requested fuel flow; and a cylinder activation/deactivation module that deactivates at least one of a plurality of cylinders in response to a determination that the requested fuel flow exceeds a maximum fuel flow of a fuel pump during cold start.

2. The cold start control module of claim 1 wherein the cylinder activation/deactivation module deactivates the at least one of the cylinders when engine speed is below a threshold.

3. The cold start control module of claim 1 wherein the maximum fuel flow of the fuel pump is directly proportional to engine speed.

4. The cold start control module of claim 1 wherein the cylinder activation/deactivation module determines a number of the cylinders that are needed to be deactivated based on the requested fuel flow and the maximum fuel flow of the fuel pump.

5. The cold start control module of claim 1 wherein the fuel flow determination module determines an equivalence fuel ratio (EQR) based on a fuel flow request.

6. The cold start control module of claim 5 wherein the cylinder activation/deactivation module compares the EQR with the maximum fuel flow of the fuel pump.

7. The cold start control module of claim 1 wherein the cylinder activation/deactivation module activates the at least one of the cylinders when the requested fuel flow does not exceed the maximum fuel flow of the fuel pump after the at least one of the cylinders is deactivated.

8. A method of starting a direct injection engine comprising:

determining a requested fuel flow; and deactivating at least one of a plurality of cylinders in response to a determination that the requested fuel flow exceeds a maximum fuel flow of a fuel pump during cold start.

9. The method of claim 8 wherein the deactivating is performed when engine speed is below a threshold.

10. The method of claim 8 wherein the maximum fuel flow is directly proportional to engine speed.

11. The method of claim 8 further comprising determining a number of the cylinders that need to be deactivated based on the requested fuel flow and the maximum fuel flow of the fuel pump.

12. The method of claim 8 further comprising determining a requested equivalence ratio (EQR) based on the requested fuel flow.

13. The method of claim 12 further comprising comparing the EQR with the maximum fuel flow of the fuel pump.

14. The method of claim 8 further comprising activating the at least one of the cylinders when the requested flow does not exceed the maximum fuel flow after the at least one of the cylinders is deactivated.

15. The cold start control module of claim 4 wherein a number of the cylinders that are active corresponds to the maximum fuel flow of the fuel pump.

16. The method of claim 11 wherein a number of the cylinders that are active corresponds to the maximum fuel flow of the fuel pump.

* * * * *